United States Patent [19]

Hudson et al.

[11] 4,069,069

[45] Jan. 17, 1978

[54] METHOD FOR IMPROVING THE SURFACE QUALITY OF ANNEALED STEEL STRIP

[75] Inventors: Robert M. Hudson, Churchill Borough; Edward J. Oles, Jr., Pittsburgh; Clair John Warning, Plum Borough, all of Pa.

[73] Assignee: United States Steel Corporation, Pittsburgh, Pa.

[21] Appl. No.: 710,997

[22] Filed: Aug. 2, 1976

[51] Int. Cl.[2] ..... C21D 1/74

[52] U.S. Cl. ..... 148/12.1; 148/16

[58] Field of Search ..... 148/12.1, 16, 16 DE

[56] References Cited

U.S. PATENT DOCUMENTS

| | | | |
|---|---|---|---|
| 2,656,285 | 10/1953 | Burns et al. | 148/16 DE |
| 3,215,566 | 11/1965 | Mayer | 148/16 |
| 3,355,265 | 11/1967 | Hudson et al. | 148/12.1 |
| 3,406,047 | 10/1968 | Magor et al. | 148/12.1 |

*Primary Examiner*—W. Stallard

*Attorney, Agent, or Firm*—Arthur J. Grief

[57] ABSTRACT

The discoloration or off-luster border area known as "annealing border", which may form on low-carbon steel strip during box annealing of coils in commercial HNX atmospheres is eliminated by (a) subjecting the strip to oxidizing conditions such that the coil edges undergo a weight gain of 0.08 to 0.8 mg/cm$^2$ of strip surface and (b) reducing the so-formed oxide during box annealing.

2 Claims, 1 Drawing Figure

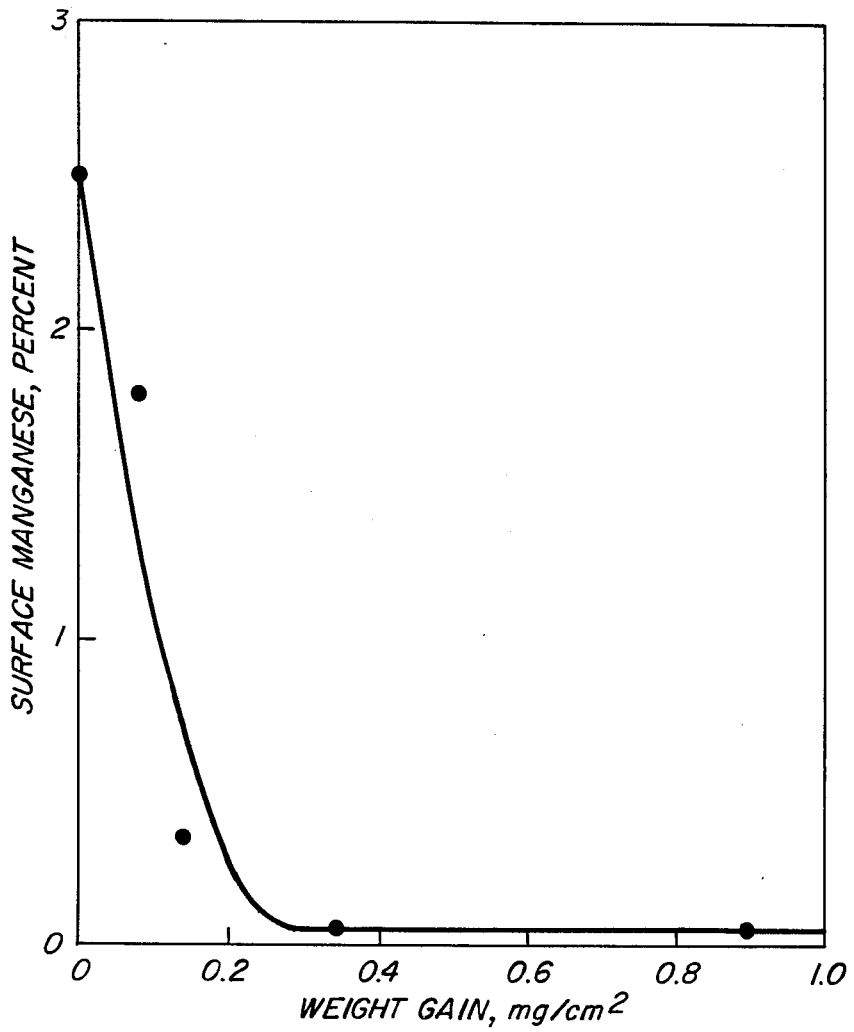
3
2
1
0
SURFACE MANGANESE, PERCENT
0
0.2
0.4
0.6
0.8
1.0
WEIGHT GAIN, mg/cm2

METHOD FOR IMPROVING THE SURFACE QUALITY OF ANNEALED STEEL STRIP

In the production of steel strip intended for a variety of "tin-mill products", eg. food containers, low-carbon steel slabs are hot rolled into coils; thereafter the coils are pickled to remove the oxides formed during hot-rolling, cold-reduced, cleaned and annealed. After annealing at temperatures in the range 1050° to 1400° F (566°to 750° C), the coils may be temper rolled and/or again cold-reduced and either (a) used directly as "black plate—QAR" (quality-as-rolled) or (b) first coated with a corrosion resistant film, generally tin or chromium. For many purposes, continuous annealing may provide the requisite physical characteristics; for softer tempers, however, box annealing is generally required. This invention is concerned with surface defects associated with annealing to such softer tempers.

During box annealing, coils are stacked with eyes vertical and an inner cover is placed over each of several such stacks. The furance itself serving as an outer cover, is then placed over several such stacks. A protective atmosphere, typically one made up primarily of $N_2$ with 2 to 10% $H_2$, but also containing small amounts of $H_2O$, CO and $CO_2$ is admitted under the inner covers to prevent steel oxidation during annealing.

As a result of such annealing, a number of different surface defects have been encountered, some of which are now less common because of improved production practice: (i) Carbon edge deposits result from deposition of carbonaceous components of the gas (e.g. CO, $CO_2$, $CH_4$) or from charring of residual lubricants from cold rolling that may remain on the strip surface. This problem may be avoided by adequate cleaning of the cold-reduced strip, usually electrolytically, followed by a thorough rinsing prior to annealing, and then annealing in a gas containing low residual levels of carbonaceous components; (ii) Oxide stain may result from the failure to insure adequate flow of the protective atmosphere, and thereby avoid air infiltration into the inner cover gases, especially during cooling of the coils, and (iii) "Annealing border," the defect which is of concern here, may result even when proper production practices are adhered to.

"Annealing border" is an off-luster or gray border often encountered after box-annealing to T-1 tempers, this condition being particularly severe for the top edge of the top coil in a stack and for steels having Mn contents within the range of about 0.30 to 0.60 percent. Elimination of this border is particularly critical in applications where appearance is of concern. Thus, when the steel strip is plated with a comparatively thick coating, i.e. electrocoated tin, the defect is often masked. However, for uses such as QAR product, or TFS product in which an extremely thin coating of chromium is applied to the steel, the masking is ineffective, producing a product unacceptable for many consumer uses.

It is therefore a principle object of this invention to provide a method for producing low carbon, cold-rolled tin mill gage steel coils in T-1 tempers without the formation of "annealing broker" thereon.

A further object of this invention is to provide a process for preventing the formation of an "annealing border" on cold-rolled tin mill gage steel coils during box annealing.

These and other objects of the instant invention will become more apparent from a reading of the following description, when read in conjunction with the appended claims and the drawings in which:

The FIGURE shows the effect of a pre-oxidation treatment, in accord with the instant invention, in eliminating surface enrichment of mangeanese.

To identify the nature of this "annealing border," examination of commercially and laboratory annealed steels by scanning electron microscopy (SEM) with energy dispersive X-ray spectromerty has proved particularly fruitful. SEM examination of the border defects of commercially box annealed steel samples revealed the presence of submicron size particles rich in manganese. The particles are primarily manganese oxide and/or spinel-type oxides of iron and manganese. It was further found that these particles become flattened out or rolled into the surface during subsequent temper rolling or cold reduction and were easily removed during cleaning and pickling of the strip. The removal of these particles thereby results in a pitted surface, producing the undesirable off-luster appearance. Reflowed coatings, such as electrolytic tin plate, offer a generally satisfactory appearance even though pits are formed in the substrate during processing. Manganese enrichment occurs to a much lesser degree on the sheet away from the border zone, as manifested by the presence of smaller and smaller particles of decreased frequency. It is the contrast in appearance between the border and the adjacent area that is associated with the non-uniform appearance of commercial product. It was further found that this undesirable manganese enrichment at the border areas was caused by the fact that conventional HNX atmospheres, although nonoxidizing at annealing temperatures to the iron matrix, were in fact oxidizing to more readily oxidizable elements such as manganese and silicon. In this regard, it should be noted that high purity HNX atmospheres would not be oxidizing to any of the elements conventionally found in these steels. However, commercial HNX atmospheres always contain small amounts of water vapor and free oxygen, thus rendering the atmosphere oxidizing to manganese at box annealing temperatures. During a prolonged box anneal, manganese is oxidized on a steel surface, with such oxidation being most pronounced at the surfaces closest to the incoming, fresh HNX gas containing such water vapor and/or free oxygen. As uncombined surface manganese is depleted due to oxidation, additional manganese is diffused to the depleted surface area, resulting in even further manganese oxidation. Such diffusion of manganese to the depleted surface area results in the eventual enrichment of manganese, in the form of manganese oxides, often more than an order of magnitude greater than the manganese concentration in the bulk of the steel.

A useful concept in understanding the mechanism of surface enrichment in manganese, is that of "free manganese," i.e., manganese not combined in inclusions with either oxygen or sulfur. The "free manganese" content is the total manganese concentration of the steel minus the manganese bound-up in such inclusions. Manganese present as sulfide inclusions may be estimated by multiplying the sulfur concentration of the steel, in weight by percent, by 1.71. For steels having aluminum levels below about 0.01 percent, manganese present as an oxide or silicate may range from as low as 0.01 percent for comparatively high silicon-containing steels, to about 0.06 percent for steels having silicon levels below about 0.02 percent. The level of manganese combined as inclusions can therefore be increased by either (a) lowering the silicon and aluminum contents and/or (b) increasing the oxygen and sulfur contents. Thus, the free manganese level in the steel can be lowered by (i) increasing the amount of manganese combined as inclusions or (ii) by the even simpler expedient of decreasing the total manganese content of the steel. It was found that the degree of surface enrichment in manganese which results in "annealing border," is directly related to the "free manganese" concentration of the steel. For example; steel A, having a "free manganese" content of 0.38 percent, and steel B, having a "free manganese" content of 0.21 percent were annealed for seven hours at 1350° F in an HNX-type atmosphere having 6% hydrogen and 0.05% water vapor. The resultant surface manganese contents in the outermost 2000A. layer of the steel surface were 11.4 and 3.9 percent respectively—a greater difference than might be expected by comparing the total manganese levels (0.43 and 0.32 percent, respectively) alone.

With the knowledge that visible "annealing border" is caused by surface enrichment of manganese and that such surface enrichment is a function of the free manganese content of the steel, it becomes apparent that the tendency to "annealing border" could be minimized or totally eliminated by modification of steel chemistry. This expedient is more fully discussed in U.S. Pat. Application, Ser. No. 633,759, filed Nov. 20, 1975, the disclosure of which is incorporated herein by reference. However, steelmaking practices (e.g. deoxidation, casting characteristics) do not always permit restriction of steel chemistry. Therefore, further work was directed towards the development of an annealing practice that would overcome the tendency for formation of manganese rich particles on the surface of a low-carbon steel strip.

Table I

| | Chemical Compositions of Steels - weight % | | | | | | | |
|---|---|---|---|---|---|---|---|---|
| Sample No. | C | Mn | P | S | Si | Al | O | N |
| A | 0.052 | 0.43 | 0.004 | 0.015 | 0.058 | 0.001 | 0.015 | 0.006 |
| B | 0.065 | 0.32 | 0.005 | 0.036 | 0.006 | 0.001 | 0.040 | 0.003 |
| C | 0.039 | 0.42 | 0.006 | 0.014 | 0.056 | 0.001 | 0.023 | 0.003 |

In a laboratory study in which steels susceptible to annealing border formation were employed, (i.e. steels having a free manganese content of 0.2 to 0.55%), the effect of oxide films on surface manganese concentration was studied by heating the steel in air of oxygen-nitrogen mixtures at lower temperatures, followed by a reducing annealing treatment at higher temperatures. Surprisingly, it was found that oxide films formed under strongly oxidizing conditions could readily be reduced, to furnish a surface containing significantly lower manganese concentrations than steel annealed without preoxidation. It was further found that when oxidation was permitted to proceed to a sufficient extent, the resultant annealed steel surface actually contained lower levels of manganese than that of the bulk steel composition. This effect is illustrated in the FIGURE, for steel C, which was preoxidized at 800° C) for various time period in air containing 1.5 percent water vapor and thereafter annealed for 7 hours at 1350° F (732° C) in a conventional HNX-type atmosphere containing 6% $H_2$ — 94% $N_2$ with about 1.5 percent water vapor, to reduce the oxide formed thereon. Not only were surface manganese levels substantially lowered by such preoxidation, but SEM examination revealed that, except for the specimen having 0.08 mg/cm² weight gain during preoxidation, manganese rich particles were absent. Even this latter specimen, after annealing at 1350° F, exhibited only very small manganese rich particles and with very low frequency.

As noted above, the degree of preoxidation required to inhibit surface enrichment in manganese is a function of the free manganese content of the steel. Thus, for steels having low free manganese levels, i.e. within the range of about 0.2 to 0.25 percent free manganese, a weight gain of 0.08 to 0.15 mg/cm² will generally be adequate; whereas for steels having comparatively high free manganese levels (i.e. in excess of 0.35 percent) a weight gain of at least 0.2 mg/cm² may be required. To ensure an adequate degree of preoxidation, it is therefore preferable that the surface of the strip, within about 3 inches of the coil edges, undergo a weight gain of 0.1 to 0.3 mg/cm². The weight gain should never exceed 0.8 mg/cm². In all instances, it is desirable that preoxidation be carried out to an extent to reduce the as-annealed surface manganese level, at least to about that of the bulk manganese concentration in the steel.

A wide range of preoxidizing atmosphere compositions can be used to provide sufficient preoxidation. For example, preoxidation to suitable levels can also be accomplished by heating the steel in nitrogen or in hydrogen-nitrogen mixtures containing high levels of water vapor. Atmospheres of this latter category, (a) $N_2$ — 2.9% $H_2O$ and (b) $N_2$ — 6% $H_2$ — 2.9% $H_2O$, were employed to heat specimens of steel A from 400 to 1000° F at a rate of 150° F/hr. to effect weight gains of 0.16 and 0.14 mg/cm² respectively; the corresponding surface manganese levels (in the top 2,000 A. layer) after a seven hour reducing anneal were 0.18 and 0.13%, respectively. These levels are to be compared with the 2.6% level, which was reached when similar specimens of steel A, that were not preoxidized, were given the same reducing anneal.

Obviously, during commercial production, the use of a separate step to effect preoxidation will add significantly to costs. However, a suitable preoxidation can readily be accomplished by metering air or other oxygen-nitrogen mixtures into the inner cover gases during heat-up and thereafter admitting the protective reducing atmosphere in the later stages of the box annealing treatment. This latter procedure will require only a small modification of the delayed purge box annealing cycles presently employed in many commercial box annealing treatments. Such a delayed purge practice is shown, for example, in the paper by Howkins et al., *Iron and Steel Engineer,* Nov. 1968, pages 73–79, see especially page 78.

Prior to the use of delayed purge practices, it was common box annealing practice to use a pre-purge of a DX-type gas to eliminate the air under the annealing covers so as to (a) prevent oxidation of the sheet or strip and (b) decrease the danger of explosions resulting from the reaction of the oxygen in the air with the $H_2$ and CO in the DX gas. It was found, however, that if a delayed purge were employed, then the danger of an explosion was minimized as a result of the reaction of the oxygen under the covers with (i) the carbon in the lubricating oils on the strip surface and (ii) the iron in the strip and in the cover. It was also found that this reaction of oxygen with the carbon in the oils provided a further benefit, in that it decreased the tendency to form carbon deposits on the surface of the strip. When such a conventional delayed purge is employed, a weight gain of the order of about 0.02 mg/cm² will be achieved. In a few cases, when comparatively small charges are employed, the weight gain may approach 0.04 mg/cm², a value too small to achieve the desired reduction in surface manganese concentration. Since the extent of preoxidation, utilizing a conventional delayed purge, is limited by the initial amount of air present under the inner cover it will be necessary, in order to achieve a minimum weight gain of at least about 0.08 mg/cm², that additional amounts of a free oxygen containing gas be admitted to the inner cover gases. The quantities of such free oxygen-containing gas, e.g. air, will depend on the gage and charge weight of the steel; from these the surface area and the border area of the coils can therefore be estimated; for example, taking 3 inches from each edge as defining the "affected" border zone. As an illustrative example, for a 60 ton charge of four-36 inch wide steel coils, having a thickness of 0.01 inch, the "affected" border zone area (both sides of the steel) will be 95,700 sq. feet. If it were required to pre-oxidize all four coils to a level of 0.2 mg/cm² weight gain, a quantity of air of about 2,100 cu. feet would be required. In actual practice the top coil in the stack, because of gas circulation and higher edge temperature, is more prone to annealing border formation than the other coils in the stack. Therefore, a reasonably good measure of protection will be realized by utilizing a quantity of air somewhat in excess of that required for the top coil alone, e.g. about 1,000 cu. feet of air. It should be borne in mind that such a calculation provides only a reasonable estimate for starting point, since under actual operation conditions, the amount of air required will also be influenced by the heating rate and the tightness of the coil wraps.

We claim:

1. In the production of low-carbon steel sheet, containing a bulk concentration of from about 0.2 to 0.55 percent free manganese in solid solution, wherein said sheet is cold rolled to desired gage, wound into coils and then box annealed, at an annealing soak temperature between 1050° to 1400° F, in an atmosphere which is protective to the iron in said sheet, said atmosphere containing $H_2$ and $N_2$ and having an oxidation potential which is preferentially oxidizing to manganese; whereby during said box annealing the manganese concentration in the surfaces of said coils at the edges thereof, is substantially enriched over that of said bulk manganese concentration, thereby resulting in an undesirable appearance known as "annealing border,"

the improvement which comprises, (a) at a temperature not substantially higher than said annealing soak temperature, heating said coils in an atmosphere which is oxidizing to iron so as to provide an iron oxide weight gain within the range 0.08 to 0.8 mg/cm² of strip surface and (b) thereafter annealing said coils in said protective atmosphere, said annealing being conducted for a time at least sufficient to reduce said iron oxide, and wherein the weight gain from said step (a) oxidizing treatment is at least sufficient to reduce the manganese concentration in the surface of said sheet at the edges thereof, to approximately the bulk manganese concentration.

2. In the production of low-carbon steel sheet, containing a bulk concentration of from about 0.2 to 0.55 percent free manganese in solid solution, wherein said sheet is cold rolled to desired gage, wound into coils and then box annealed, at an annealing soak temperature between 1050° to 1400° F, in an atmosphere which is protective to the iron in said sheet, said atmosphere containing $H_2$ and $N_2$ and having an oxidation potential which is preferentially oxidizing to manganese; whereby during said box annealing the manganese concentration in the surfaces of said coils at the edges thereof, is substantially enriched over that of said bulk manganese concentration, thereby resulting in an undesirable appearance known as "annealing border,"

the improvement which comprises, a. at a temperature within the range of 400° to 1000° F, heating said coils in an atmosphere which is oxidizing to iron so as to provide an iron oxide weight gain within the range 0.1 to 0.3 mg/cm², said weight gain being generally proportional to the bulk free manganese concentration of said sheet and b. thereafter annealing said coils in said protective atmosphere, said annealing being conducted for a time protective atmosphere, said annealing being conducted for a time at least sufficient to reduce said iron oxide, and wherein the weight gain from said step (a) oxidizing treatment is at least sufficient to reduce the manganese concentration in the surface of said sheet at the edges thereof, to approximately the bulk manganese concentration.

* * * * *

UNITED STATES PATENT OFFICE

CERTIFICATE OF CORRECTION

Patent No. 4,069,069 Dated January 17, 1978

Inventor(s) Robert M. Hudson, Edward J. Oles, Jr. and Clair J. Warning

It is certified that error appears in the above-identified patent and that said Letters Patent are hereby corrected as shown below:

Column 1, line 62, "annealing broker" should be -- annealing border --;

Column 2, line 5, "mangeanese" should be -- manganese --;

Column 3, line 60, "preoxidized at 800°C) for" should read -- preoxidized at 800°F (427°C) for --;

UNITED STATES PATENT OFFICE

CERTIFICATE OF CORRECTION

Patent No. 4,069,069 Dated January 17, 1978

Inventor(s) Robert M. Hudson, Edward J. Oles, Jr. and Clair J. Warning

It is certified that error appears in the above-identified patent and that said Letters Patent are hereby corrected as shown below:

Claim 2, subparagraph b., "thereafter annealing said coils in said protective atmosphere, said annealing being conducted for a time protective atmosphere, said annealing being conducted for a time at least sufficient to reduce said iron oxide," should be -- thereafter annealing said coils in said protective atmosphere, said annealing being conducted for a time at least sufficient to reduce said iron oxide, --;

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*